United States Patent [19]

Senillou et al.

[11] Patent Number: 4,858,675

[45] Date of Patent: Aug. 22, 1989

[54] PROCESS AND APPARATUS FOR PREPARING ESPECIALLY METALLIC AND SEMI-METALLIC BANDS OF SMALL THICKNESS

[75] Inventors: Claude Senillou, Voreppe; Rémy de Framond, Grenoble; Marcel Garnier, Uriage; Ali R. Yavari, Grenoble; Jean-Charles Joud, Meylan, all of France

[73] Assignee: Union Siderurgique Du Nord Et De L'Est De La France (USINOR), Puteaux, France

[21] Appl. No.: 189,952

[22] Filed: May 3, 1988

Related U.S. Application Data

[60] Division of Ser. No. 925,470, Oct. 30, 1986, Pat. No. 4,762,653, which is a continuation of Ser. No. 692,185, Jan. 17, 1985, abandoned.

[30] Foreign Application Priority Data

Jan. 18, 1984 [FR] France ..... 84 00747

[51] Int. Cl.[4] ..... B22D 27/02

[52] U.S. Cl. ..... 164/503; 164/502; 164/423

[58] Field of Search ..... 164/423, 462, 463, 466, 164/467, 502, 503

[56] References Cited

FOREIGN PATENT DOCUMENTS

| | | | |
|---|---|---|---|
| 2525508 | 10/1983 | France | 164/463 |
| 57-177861 | 11/1982 | Japan | 164/466 |
| 782951 | 11/1980 | U.S.S.R. | 164/467 |

*Primary Examiner*—Kuang Y. Lin
*Attorney, Agent, or Firm*—Cushman, Darby & Cushman

[57] ABSTRACT

The invention relates to the preparation of especially metallic or semi-metallic bands or sheets, particularly with a microcrystalline or amorphous structure. According to this process, an electrically conductive molten material is made to flow from a tank through a nozzle, to form a strip of substantially rectangular cross-section, which is subsequently solidified. According to the invention, the form of the strip of liquid material is stabilized, after it has been shaped and before solidification, as a result of a mechanical surface effect induced by an alternating magnetic field.

10 Claims, 3 Drawing Sheets

Figure 1:
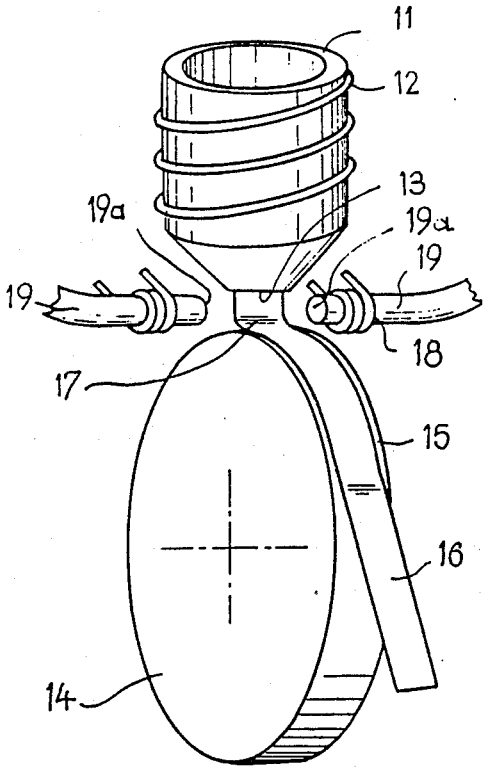

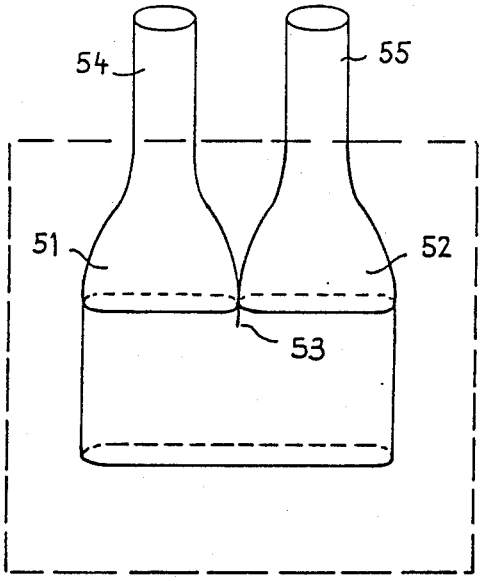
FIG. 5
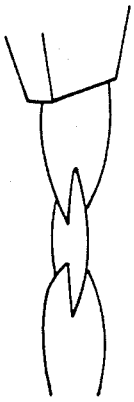
FIG. 7
FIG. 6
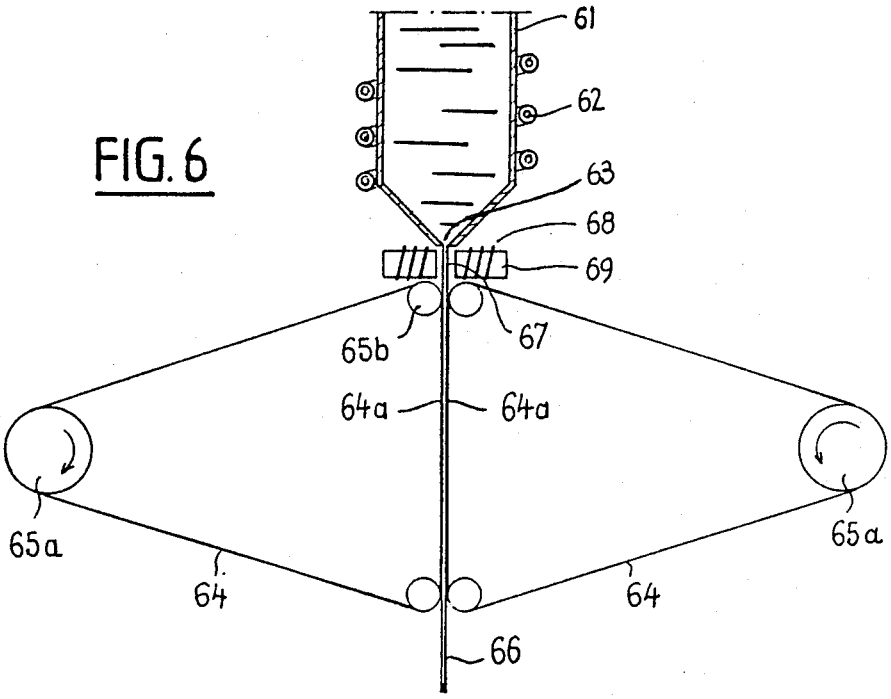

PROCESS AND APPARATUS FOR PREPARING ESPECIALLY METALLIC AND SEMI-METALLIC BANDS OF SMALL THICKNESS

This is a division of application Serial No. 925,470, filed Oct. 30, 1986, now Patent No. 4,762,653, which was a continuation of Serial No. 692,185, filed January 17, 1985, now abandoned.

The present invention relates to processes and apparatuses for preparing bands, and more specifically metallic or semi-metallic bands, of small thickness, especially those bands having a microcrystalline or amorphous structure.

The simplest process for producing such thin metallic bands involves projecting a jet of liquid metal onto a movable substrate, such as the surface of a metal roller rotating at a circumferential speed higher than 10 m/second. This process is called "melt-spinning". The major problem to be solved relates to the shape stability of the jet during its impact and solidification on the substrate, because of the relatively high impact velocity, which is increased, in particular, as a result of the acceleration due to gravity. Moreover, it is impossible to produce bands of a width greater than 1 cm by means of this process.

There is a known process described particularly in the document FR-A-2,368,324 (77 31 659). According to this process, the liquid metal is poured through a slit, the width of which varies from 0.2 to 1 mm and the length of which can be several centimeters. This slit is located at a distance from the movable substrate which is less than 1 mm and is most often of the order of 0.1 mm, thus making it possible to mitigate the disadvantage of the first process mentioned above, since the substrate on which the metal solidifies is at a very short distance from the slit through which the liquid metal flows. However, this process also has serious disadvantages: it requires very special and very strict conditions as regards the machining and surface state of the lips delimiting the slit. These lips are subjected to considerable wear because of the drag effect exerted on the metal in the immediate vicinity of these lips. Moreover, it is also necessary for the wheel constituting the substrate on which the metal solidifies to have very narrow dimensional tolerances, so that it is possible to obtain a band of approximately constant thickness, since the thickness of the band is partly determined by the distance between the lips and this substrate.

The document FR-A-82 06 876 describes a process, according to which a jet of liquid metal of circular cross-section is deformed, as a result of the application of a magnetic field, up to a point when it assumes the shape of a band or a strip parallel to this field. However, this process requires a minimum forming time, during which the magnetic field must act on the initial cross-section of the metal, counter to the surface tension of the liquid, in order to deform this cross-section until the desired final shape is obtained.

During this time, the liquid metal is subjected to the effect of gravity, so that the strip formed reaches its effective width outside the zone of the magnetic field, precisely when the maximum stabilizing action of the field would be necessary to maintain it as it is. Furthermore, the strip formed in this way can have only a limited width because of the rapid decrease of the magnetic fields in air.

It should be noted that three types of physical problems are detrimental to the accurate control of constant thickness and width of the liquid strip during the time when it flows in air:

(a) Instability attributed to the different speeds of the fluid constituting the strip and the ambient atmosphere. This instability (Kelvin-Helmholtz), which develops very quickly, takes the form of a series of parallel ridges, above all perpendicular to the direction of flow, which result in a modification of thickness in the longitudinal direction of the strip.

(b) Instability attributed to the disturbances generated in the region of the outlet of the nose of the nozzle from which the fluid flows. These disturbances do not have a preferred direction and depend on the geometry of the nozzle.

(c) Instability attributed to the surface tension and gravitational acceleration which tends to reduce the width of the strip and to restore a circular cross-section to it. This instability develops much less rapidly than the preceding instability and results in the appearance of successive antinodes with a rotation of 90° at each node FIG. 7). The ridges are parallel to the edge of the strip and the modifications in thickness are in a direction perpendicular to the speed of the jet.

Finally, there is a known publication JP-A-57-17781, in which a metal strip formed on a heat-exchanger substrate is subjected to the action of a magnetic field generated in a zone near to the point of solidification of the metal. This magnetic field has a direction perpendicular to the direction of advance of the metal strip and the lines of flux passing through it. It is clearly indicated and explained that the proposed object is to increase the viscosity by means of a braking action on the fluid particles, thus necessitating a low-frequency continuous or alternating field penetrating the mass of flowing fluid.

Now this specific type of field penetrating the stream of flowing metal exerts virtually no stabilizing action at all on the shape instabilities which were defined above under a, b and c and which the present invention is specifically aimed to overcome in the formation of a metal strip to be projected onto the heat-exchange substrate.

None of the known processes therefore makes it possible to obtain a wide band with uniform dimensions, without placing the crucible at a distance of less than 1 mm from the movable substrate. The specific object of this invention is to provide an original process and an original apparatus which make it possible to obtain such a product, whilst at the same time doing away with the constraints which, in the second process analyzed above, relate to the production of the lips of the slit and to the wear of the latter.

For this purpose, the main subject of the invention is a process for preparing a band from an electrically conductive liquid, of the type in which a molten material is made to flow from a tank through a nozzle, to form a strip of substantially rectangular cross-section which is subsequently solidified, this process being defined in that the form of the strip of liquid material is stabilized, after it has been shaped and before solidification, by means of a mechanical surface effect induced by an alternating magnetic field.

According to other characteristics:

the incident magnetic field is parallel to the strip and preferably orthogonal to the longitudinal axis of the strip, the incident magnetic field is perpendicular to the strip, the form of the strip is stabilized as a result of the action, on at least one face of the strip, of an incident magnetic field which is perpendicular to the strip and which is subsequently looped on itself, in such a way that the lines of flux from the incident field are subsequently directed parallel to the surface of the strip and are then redirected perpendicularly to the latter to form the loop, the field is looped in a vertical direction, if appropriate in combination with looping in a horizontal direction, the nozzle has a cross-section in the shape of a substantially rectangular slit, the nozzle has a substantially circular cross-section, and the substantially cylindrical stream of liquid metal is preformed in the shape of a strip as a result of the action of at least two opposing incident magnetic fields located, opposite one another, on each side of this stream, and stabilization is effected by means of a looping of the field, as described above, a strip of large width is obtained as a result of the coalescence of narrower individual strips along their longitudinal edges, the strip is solidified when the stabilized strip is brought in contact with a movable substrate.

The subject of the invention is also an apparatus for carrying out the process, as defined above, of the type comprising a tank containing a molten material and possessing in its lower part a nozzle for the flow of this material and, downstream of the tank, means of forming a strip and of solidifying the latter, this apparatus being defined in that it incorporates, in the zone located between the strip formation means and the solidification means, electromagnetic means designed to exert on the surface of the strip a mechanical stabilizing effect generated by an alternating magnetic field.

According to other chacteristics:

the means generating the alternating magnetic field comprise at least two coaxial induction coils which surround cooled cores of ferrite or another equivalent material and which are arranged on either side of the strip of liquid material issuing from the nozzle, the axis of the coils being substantially contained in the plane of this strip, and the coils being supplied in such a way that the ends of the opposing ferrite cores which face the strip are opposite poles, the means generating the alternating magnetic field comprise at least one pair of coaxial induction coils which surround cooled cores of ferrite or another equivalent material and which are arranged on either side of the strip of liquid material issuing from the nozzle, the axis of the coils being perpendicular to the plane of the said strip and the coils being supplied in such a way that the ends of the opposing ferrite cores which face the strip are like poles, the apparatus possesses at least two pairs of coaxial induction coils arranged above one another, the core of ferrite or another equivalent material forming, with the ferrite core of the adjacent coil located on one and the same vertical line and facing one and the same side of the strip, a U-shaped ferrite circuit which channels the lines of flux so as to make them, in the flux gap, substantially parallel to the longitudinal axis of the strip, the apparatus possesses at least two pairs of coaxial induction coils arranged next to one another in one and the same horizontal direction, the core of ferrite or another equivalent material forming, with the ferrite core of the adjacent coil located on one and the same horizontal line and facing one and the same side of the strip, a U-shaped ferrite circuit which channels the lines of flux so as to make them, in the flux gap, parallel to the surface of the strip and substantially horizontal, the apparatus possesses a combination of pairs of coils arranged horizontally and vertically, as defined above, so that the poles of two adjacent ferrite cores opposite one and the same face of the strip are alternate, the nozzle has a cross-section in the shape of a substantially rectangular slit, the nozzle has a substantially circular crosssection, and the substantially cylindrical stream of liquid metal is preformed in the shape of a strip as a result of passage between the upper coils of the vertically arranged pairs of coils defined above, stabilization being effected as a result of passage between the coils located at a lower level, the coils are supplied with an alternating current at high frequency between approximately 3 and 3000 kHz, the intensity of the magnetic field is between approximately 1 and 1000 millitesla, the solidification means comprise, for example, a movable substrate, on which the material is deposited in the form of two endless belts comprising two parallel sides facing one another and delimiting between them a gap located in alignment with the nozzle and the strip issuing from this nozzle, the two sides moving in the same direction as the said strip.

Figure 2:
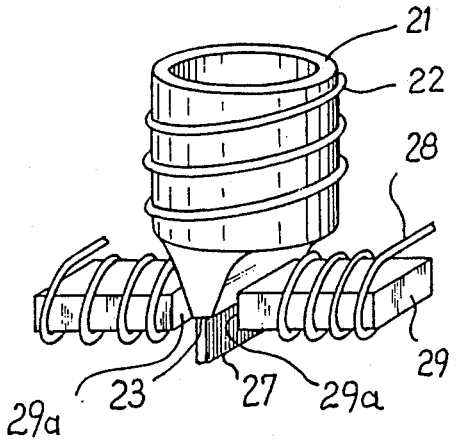
Figure 3A:
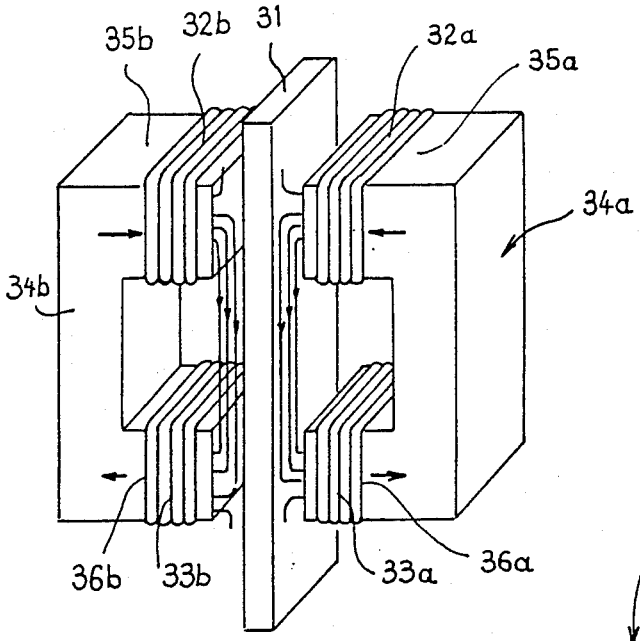
Figure 3B:
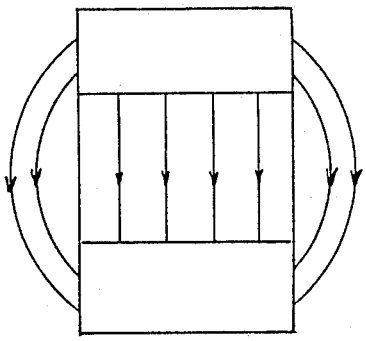
Figure 4:
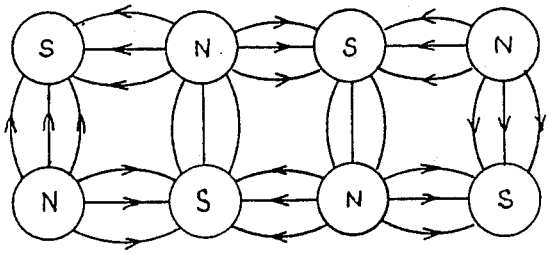

The invention will be described below with reference to the attached drawings which are given solely by way of example and in which:

FIG. 1 is a diagrammatic perspective view of an apparatus according to the invention, FIG. 2 is a partial perspective view of an alternative form, FIG. 3A is a diagrammatic perspective view of the apparatus of the present invention, in an embodiment of the second alternative form in which stabilization is effected by means of vertical looping of the magnetic field, FIG. 3B is a diagrammatic elevation view of the inductors 3A seen from the strip, and illustrating the lines of flux, FIG. 4 is a diagrammatic view of the arrangement of the poles of the ferrite cores facing the strip, in an embodiment of the second alternative form in which stabilization is obtained by means of combined vertical and horizontal magnetic looping, FIG. 5 is a diagrammatic representation of a third alternative form, in which a strip of large width is produced as a result of the coalescence of narrower individual strips along their longitudinal edges, the individual strips being poured from the nozzle of circular cross-section and then preformed and stabilized according to the alternative form of FIGS. 3 and 4, FIG. 6 is a diagrammatic view illustrating a method of contacting the movable substrate, FIG. 7 illustrates a phenomenon of physical modification of a metal strip formed as a result of the effect of surface tension.

It is appropriate to note, before defining the inductors according to the present invention, which are capable of providing a suitable geometry of the magnetic fields, that the effect of an alternating magnetic field of given frequency on the stability of a strip of liquid electrically conductive material is to oppose the disturbances which would tend to move the faces of the strip away from their geometrical position as a plane and parallel jet. This stabilizing effect is selective towards the disturbances, inasmuch as only the waves having ridges perpendicular to the direction of the magnetic field are reduced, since the effect is zero for disturbances where the ridges are parallel to the magnetic field. It should be noted, finally, that this effect is the greater, the higher the frequency of the alternating magnetic field.

The frequency of the alternating magnetic fields used to reduce the instabilities of the strip must be such that the depth of penetration into the material constituting the liquid strip is as small as possible, so as to obtain a localized mechanical effect on the surface of the strip where the disturbances occur. The electrical conductivity of the metals and semi-metals in the liquid state places the range of frequencies between 3 kHz and 3000 kHz.

The invention will be described below with reference to the production of metallic, semi-metallic or amorphous bands, but it is not limited to this and is aimed at any production of a band from an electrically conductive material.

The diagram of FIG. 1 shows an apparatus incorporating a tank 11 which can contain a molten metallic or semi-metallic material. This tank is surrounded by heating means 12, for example induction-heating means. This tank ends in its lower part in at least one slitshaped nozzle 13, the cross-section of which corresponds to the shape of the liquid strip which is to be obtained. In the selected example, this slit can have a rectangular shape with a width of 0.7 mm and a length of 20 mm.

Located underneath this nozzle, at a distance which can be between 1 and 15 mm, and is preferably between 2 and 10 mm, is a wheel 14 which can be driven in rotation and the width of which is greater than the length of the slit 13. The surface 15 of this wheel constitutes a substrate, on which the metal strip will cool very rapidly. The distance between the outlet of the slit and the surface of the substrate is greater than the width of the slit and is preferably greater than 1 mm. The surface of the substrate is designed to make it possible to detach the solidified band 16 easily. It can be cooled by any suitable means (not shown) and driven at such a rotational speed that its tangential speed at the point where it receives the molten material is compatible with the flow speed of the strip and can be of the order of 20 m per second.

In the zone located between the nozzle 13 and the receiving wheel 14 there are means making it possible to generate in this zone an alternating magnetic field exerting a mechanical stabilizing effect on the faces of the strip 17 of liquid material issuing from the nozzle. In the selected example, these means comprise two coaxial coils 18 made of electrically conductive material, for example copper, the axis of these coils being arranged parallel to the slit 13 and consequently parallel to the strip 17 and perpendicularly to the longitudinal axis of the latter. The axis of the coils is even preferably contained in the plane of this strip. The two coils can be cooled in a way known in the art. A core of ferrite or an equivalent material 19, which can also be cooled, is arranged coaxially within each coil, in order to concentrate the intensity of the magnetic field towards the liquid material issuing from the slit.

The coils are supplied with alternating currents of suitable frequency, in such a way that the ends 19*a* of the opposing ferrite cores 19 which face the strip 17 are opposite poles.

As an example, the two coils can be supplied with alternating currents of a frequency between 3 and 3000 kHz, for example of the order of 400 kHz, the intensity of the generated field being between 1 and 1000 millitesla.

In this example, the width of the band obtained corresponds to that of the slit, that is to say 20 mm, and its thickness is approximately 0.07 mm. It is obtained from a rectangular slit of 20.0×0.6 mm as a result of contact with a substrate in the form of a wheel, the tangential speed of which is 20 m/s.

In the alternative form of FIG. 2, a pair of induction coils 28 and a pair of ferrite cores 29 arranged within these coils are used. The coils are coaxial, and their common axis is perpendicular to the plane of the strip 27 issuing from the nozzle. The ferrite cores have a rectangular cross-section, and their ends are located a few millimeters from the strip of liquid metal.

In this case, the coils are supplied with alternating currents which are such that the ends 29*a* of the opposing ferrite cores which face the strip are like poles, that is to say, either both are north poles or both are south poles.

As an example, the two induction coils can be supplied with alternating current at a frequency of 500 kHz. The intensity of the field can be between 1 and 1000 millitesla. The slit of the nozzle can have a length of the order of 45 mm and a width of 0.7 mm. The distance between the outlet of the nozzle and the substrate can be of the order of 10 mm. In this case, on the assumption that the speed of the substrate, in a direction perpendicular to the feed direction of the liquid strip, is 15 m per second, a band with a width of 45 mm and a thickness of the order of 0.1 mm is obtained.

In the embodiment illustrated in FIG. 3A, a preformed strip 31 of liquid metallic material is conveyed between a first pair of coaxial induction coils 32*a*, 32*b* located on either side of the strip 31, in such a way that their common axis is perpendicular to the plane of the strip.

A second pair of coaxial induction coils 33*a*, 33*b* parallel to the first pair of coils 32*a*, 32*b* is arranged on one and the same vertical line and underneath the coils 32. A U-shaped ferrite core 34*a* is accommodated between the coils 32*a* and 33*a* located on one and the same side of the strip, in such a way that each branch of the U, namely 35*a* and 36*a* respectively, penetrates into the coils 32*a* and 33*a*.

The coils 32*a* and 33*a* are supplied with alternating currents, so that the strip-facing ends of the branches 35*a* and 36*a* of the ferrite cores 34*a* are opposite poles.

In FIG. 3A, the end of the branch 34*a* is a north pole, and the lines of flux of the incident magnetic field which come from this field are directed perpendicularly towards the strip and are then looped, first by travelling in a direction parallel to the strip towards the branch 36*a* which is a south pole, opposite which they are redirected perpendicularly to the strip 31 and are finally channelled up to the north pole 35*a* via the U-shaped ferrite core 34*a*.

As in the preceding alternative forms, the alternating supply current is a current of high frequency similar to that mentioned above.

On the other face of the strip, a ferrite core 34*b* similar to the U-shaped core 34*a* is inserted between the coils 32*b* and 33*b*, which are supplied in such a way that the poles of the strip-facing ferrite ends 35*a*, 35*b* or 36*a*, 36*b* of one and the same pair 32*a*, 32*b*, or 33*a*, 33*b* are like poles. In FIG. 3A, 35*a* and 35*b* are north poles and 36*a* and 36*b* are south poles.

The path of the lines of flux indicated in the FIG. 3B for one and the same face of the strip explains the stabilizing action of the generated field: the many lines of flux which are straight and parallel to the axis of the strip make it possible to reduce the most important instability (Kelvin-Helmholtz) attributed to the speed; the more curved lines of flux reduce the other types of instabilities as a result of their inclination.

It is, of course, possible to associate more than two induction coils in one and the same vertical direction, to obtain looping of the field over a greater vertical length.

According to another embodiment of this alternative form, the looping just explained above for a vertical direction can be effected horizontally with a U-shaped ferrite core of similar structure and with opposite poles at each end of the strip-facing branches of the U.

According to the embodiment of FIG. 4, which shows diagrammatically only the alternation of the poles opposite one and the same face of the strip, there is a combination of vertical and horizontal looping of the magnetic field, which offers the effect of maximum stabilization of the strip in all the directions of the plane. The alternations of the poles in the horizontal direction and vertical direction is such that two adjacent poles are always opposite in kind.

The basic configuration of FIG. 3A can be shifted in a direction parallel to the strip, as described above, when the width of the latter becomes very large. If the opposition of the directions of the magnetic fields generated by the successive coils is preserved, it is possible to obtain an isotropic stabilizing effect, as shown in FIG. 4. In fact, the arrangement of the coils allows diversification of the direction of the lines of flux and thus makes it possible to stabilize waves in different directions. There are no limits to the stabilization technique as regards the width of the strip to be stabilized.

In the embodiment of FIG. 4, the ferrite core is in the form of a mesh network similar to a grid, and from the top of each mesh of the latter depart branches which extend up to the vicinity of the strip and which carry a suitably supplied induction coil.

In addition to this stabilizing effect produced by such inductors, there is an effect causing the electromagnetic forming of the electrically conductive materials. The variation in the modulus of the magnetic field in time generates currents which are induced on the surface of the material and which interact with this field to give rise to forces (Laplace forces); these can be broken down into two separate forces, the ratio between them being proportional to the square root of the frequency (f). The higher the frequency (f), the more the effect will be a pressure force on the surface of the material; the lower the frequency (f), the more the effect will be a stirring force within the liquid material. Consequently, high-frequency alternating magnetic fields are used, these being generated by inductors with the above-defined geometry, to obtain an electromagnetic forming effect.

As a result of this embodiment, making it possible to widen the stabilization zone, whilst at the same time maintaining a magnetic field which is all the more intense, it is possible to coalesce at least two individual strips 51 and 52, shown in FIG. 5, along their common longitudinal edge 53, to obtain a perfectly stabilized strip of greater width.

This embodiment also makes it possible to produce a strip of large width from cylindrical jets 54 and 55 issuing from nozzles of circular cross-section, as a result of the preforming of the strip between the upper induction coils 32*a* and 32*b* of FIG. 3A, before stabilization. This stabilization can be obtained between a single pair of coils or between other pairs of coils placed underneath and to the side in a repetitive pattern of the type described in FIG. 4.

In the case of a cylindrical jet flowing between the pairs of inductors, the magnetic field generated by the opposed coils tends to push back the metal and therefore form it in the shape of a uniform strip. The importance of the frequency and consequently of the skin thickness δ (depth of the action of the Laplace force within the electrically conductive material) as a function of the thickness e of the liquid strip to be formed will be noted. δ is defined by the expression:

$$\delta = \sqrt{\frac{1}{\pi \mu_0 \sigma \delta}}$$

in which $\mu$=the magnetic permeability of vacuum. δ=the electrical conductivity of the liquid material. f=the frequency of the current in the induction coils.

To obtain results acording to the present invention, δ must be of the order of e and preferably } e/2.

The strip formed in this way is subsequently stabilized as a result of the phenomenon described above. The usefulness of such an inductor is that the coils are always very near to the metal, this being very important because of the rapid decrease in the intensity of the magnetic field in air. A micrometric adjustment device can be associated with the two half-inductors, thus allowing these to be brought close to the strip or to be offset slightly relative to the formed strip, thus acting as a guide for the strip in relation to a given impact point.

It is possible to use several cylindrical jets which, flowing through identical inductors, are deformed under the action of the magnetic field, until they form strips placed next to one another, which coalesce to produce one stable and uniform strip and one only (FIG. 5). In fact, at the point of coalescence, since the speeds of the fluid particles are not parallel, the result is that a protuberance is produced on the surface of the strip. This type of inductor makes it possible to mitigate this disadvantage by stabilizing the strip in a uniform way. There are no limits either to this forming technique as regards the width of the strip to be stabilized.

The embodiment of FIG. 6 incorporates a tank or crucible 61 which is surrounded by an induction-heating device 62 and which ends in its lower part in a nozzle 63 delimiting a substantially rectangular slit.

The magnetic device making it possible to stabilize the form of the liquid strip issuing from this tank can be as described above and illustrated in FIG. 3A. The essential originality of this third embodiment concerns the cooling substrate. Here, this takes the form of two conveyor belts 64 passing over drive rollers 65*a* and over guide rollers 65*b* and 65*c*. These two belts comprise two vertical sides 64*a* which here are located between the guide rollers 65*b*, 65*c* and which are arranged opposite one another in the prolongation of the slit of the nozzle 3. These two sides are therefore parallel to the liquid strip 67 issuing from the nozzle and move in the same direction as the strip. The latter is therefore received between the two receiving belts, being retained effectively, and the solidified band 66 is easily extracted in the lower part of the apparatus. Of course, the conveyor belts acting as a cooling substrate can be cooled by suitable means (not shown).

In this embodiment, the band can have an improved dimensional stability because of the guidance between the two adjacent belts 64*a*.

The proposed process and apparatus satisfactorily achieve the desired objectives:

the lips of the nozzle from which the liquid material flows are not subjected to the same stresses as they are in the process in which the cooling substrate is located very near to the outlet of the slit, so that, in the apparatus according to the invention, the nozzle can be produced in a simpler and less expensive way. Moreover, it has a much longer service life, since it is subjected to much less erosion. The risks that this nozzle will become blocked are also substantially reduced, furthermore, the dimensional stability of the liquid strip is ensured in an effective way, and this makes it possible to obtain a band of uniform dimensions both in terms of thickness and in terms of width, this result is obtained by a relatively simple means and because the distance between the outlet of the nozzle and the receiving substrate is maintained at a sufficiently low value to ensure that the liquid strip arrives on the cooling surface at a low speed, at all events at a speed sufficiently low to avoid causing any disturbance, the process according to the invention also makes it possible to obtain, in a stable and uniform manner, thin metallic bands having a large width.

We claim:

1. An apparatus for preparing a strip from an electrically conductive molten liquid, the apparatus comprising a tank for the molten liquid, a nozzle having a substantially rectangular discharge opening for producing a liquid stream of substantially rectangular cross-section strip, electromagnetic means for producing an alternating magnetic field for stabilization of the strip before solidification by inducing a stabilizing effect, said electromagnetic means having core means and including first and second poles to produce an incident magnetic field on at least one face of the strip with said field originating from said first pole of said electromagnetic device which has a first polarity which extends along a direction that is initially perpendicular and then parallel to the adjacent surface of the strip towards said second pole of said electromagnetic device, said second pole having a polarity opposed to said first polarity of said first pole and then extends perpendicular again to the strip and then through the core means to said first pole to form a loop path, solidification means located downstream of said electromagnetic means.

2. An apparatus according to claim 1, in which the means generating the alternating magnetic field comprise at least two coaxial induction coils (18) which surround cooled cores (19) of magnetizable material, and which are arranged on either side of the strip of liquid material issuing from the nozzle, the axis of the coils being substantially contained in the plane of this strip, and the coils being supplied in such a way that the ends (19*a*) of the opposing magnetizable material cores which face the strip are opposite poles.

3. An apparatus according to claim 1, in which the means generating the alternating magnetic field comprise at least one pair of coaxial induction coils (28) which surround cooled cores (29) of ferrite or another equivalent material, and which are arranged on either side of the strip of liquid material issuing from the nozzle, the axis of the coils being perpendicular to the plane of the said strip, and the coils being supplied in such a way that the ends (29*a*) of the opposing magnetizable material cores which face the strip are like poles.

4. An apparatus according to claim 3, which comprises at least two pairs of coaxial induction coils (32*a*, 32*b*; 33*a*, 33*b*) arranged above one another, the core of magnetizable material forming, with the magnetizable core of the adjacent coil located on one and the same vertical line and facing one and the same side of the strip, a U-shaped magnetizable circuit (34*a*, 34*b*) which channels the lines of flux to make them substantially parallel to the longitudinal axis of the strip.

5. An apparatus according to claim 3, which comprises at least two pairs of coaxial induction coils arranged next to one another in one and the same horizontal direction, the core of magnetizable material forming, with the magnetizable core of the adjacent coil located on one and the same horizontal line and facing one and the same side of the strip, a U-shaped magnetizable circuit which channels the lines of flux to make them parallel to the surface of the strip and substantially horizontal.

6. An apparatus according to claim 4 or 5, which comprises a network of pairs of coils which are arranged vertically and horizontally and of which the adjacent poles facing the strip are alternate.

7. An apparatus according to any one of claim 6, in which the nozzle has a cross-section in the shape of a substantially rectangular slit.

8. An apparatus according to any one of claim 6, in which the nozzle has a substantially circular cross-section, and the substantially cylindrical stream of liquid metal is preformed in the shape of a strip as a result of passage between the upper coils (32*a*, 32*b*) of the apparatus, stabilization being effected as a result of passage between the coils (33*a*, 33*b*) located at a lower level.

9. An apparatus according to claim 6, in which the cores (29, 34) of ferrite or a similar material extend over approximately the entire width of the said strip (27).

10. An apparatus according to claim 1, in which the solidification means comprise a movable substrate, on which the material is deposited, in the form of two endless belts (64) comprising two parallel sides (64*a*) facing one another and delimiting between them a gap in alignment with the nozzle (63) and the strip (67) issuing from this nozzle, the two sides (64*a*) moving in the same direction as the said strip.

* * * * *